United States Patent [19]

Larson

[11] Patent Number: 4,712,773

[45] Date of Patent: Dec. 15, 1987

[54] MULTIPLE PANEL PLAY AREA

[75] Inventor: Donald A. Larson, Circle Pines, Minn.

[73] Assignee: North States Industries, Inc., Minneapolis, Minn.

[21] Appl. No.: 42,028

[22] Filed: Apr. 24, 1987

[51] Int. Cl.[4] ..... E04H 17/16

[52] U.S. Cl. ..... 256/25; 256/26; 5/99 C

[58] Field of Search ..... 256/26, 27, 25; 5/99 C, 5/100, 99 B, 99 A; 16/258

[56] References Cited

U.S. PATENT DOCUMENTS

| | | | |
|---|---|---|---|
| 1,034,461 | 8/1912 | Johnson | 256/26 |
| 2,011,528 | 8/1935 | Seay | 256/26 |
| 2,670,932 | 3/1954 | Westerfors | 256/25 |
| 2,883,698 | 4/1959 | Landry | 256/25 X |
| 3,093,838 | 6/1963 | Beasley | 5/100 |

*Primary Examiner*—Andrew V. Kundrat

*Attorney, Agent, or Firm*—Terryl K. Qualey

[57] ABSTRACT

A multiple panel unit for creating a play area for young children in which each panel has a rigid rectangular frame and is connected to an adjacent panel by a hinge structure at the top and bottom of the panels permitting the panels to be pivoted with respect to each other at the hinge. The top of a first of two adjacent panels and the corresponding end of the hinge structure are formed for releasably retaining the end of the hinge and the bottom of the second of the adjacent panels and the corresponding end of the bottom hinge structure are formed with a pin and a mating recess that are matable in a direction parallel to the hinge pivot axis.

7 Claims, 7 Drawing Figures

MULTIPLE PANEL PLAY AREA

FIELD OF THE INVENTION

The present invention relates to a multiple panel unit for creating a play area for young children.

BACKGROUND OF THE INVENTION

Portable play pens or play area units have long been used to provide a safe area within which a young child can play without the constant attention of an adult. Kiddie Yard from Nu-Line Industries of Suring, Wis. and Crawl-Space from the Crawl-Space division of Con-Serv, Inc. of Cincinnati, Ohio are multiple panel units for creating a play area for young children. In those units each panel has a rigid rectangular frame and adjacent panels are connected by a hinge structure at the top and bottom of the panels, permitting the panels to be pivoted with respect to each other at the hinge. This permits the play area to be made in different shapes, for example to conform to the open area available in a living room of a home, and permits the panels to be folded up in a face-to-face relation to make the unit portable. However, each of these play area units is made with a fixed number of panels and the panels are permanently held together.

SUMMARY OF THE INVENTION

The present invention provides a multiple panel unit for creating a play area for young children in which each panel has a rigid rectangular frame and is connected to an adjacent panel by a hinge structure at the top and bottom of the panels, permitting the panels to be pivoted with respect to each other at the hinge. The top of a first of two adjacent panels has a releasable retaining means for releasably retaining one end of the hinge structure connecting the two panels and the one end of the hinge structure is complementarily formed for being retained by the releasable retaining means. The releasable retaining means includes a spring-loaded slide mechanism for retaining the hinge end when the slide mechanism is first held in an open position against the force of the spring and the hinge end is positioned in its retention position and the slide mechanism is then released and urged to its retention position by the spring. The bottom of the second of the two adjacent panels and the corresponding end of the bottom hinge structure are formed with a pin and a mating recess that are matable in a direction parallel to the hinge pivot axis.

The multiple panel play area unit of the present invention permits opening of the unit at the releasable hinge structure so that in use it is not necessary to lift the child and other objects over the panels. If a similar hinge structure is used between each of the adjacent panels then the unit can be opened between any pair of panels and, in the event any panel is damaged, it may be replaced without tools. Moreover, at each area where the releasable hinge structure is utilized, additional panels may be added to expand the play area.

THE DRAWING

DESCRIPTION OF THE PREFERRED EMBODIMENT

Figure 1:
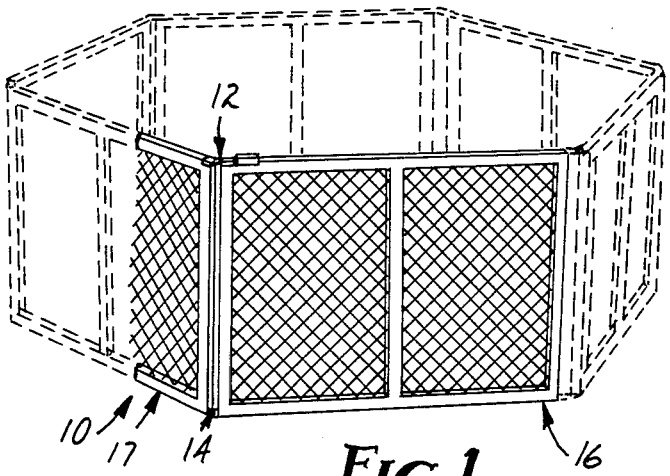
FIG. 1 is a perspective view of a multiple panel play area unit constructed in accordance with the present invention set up for use.
Figure 2:
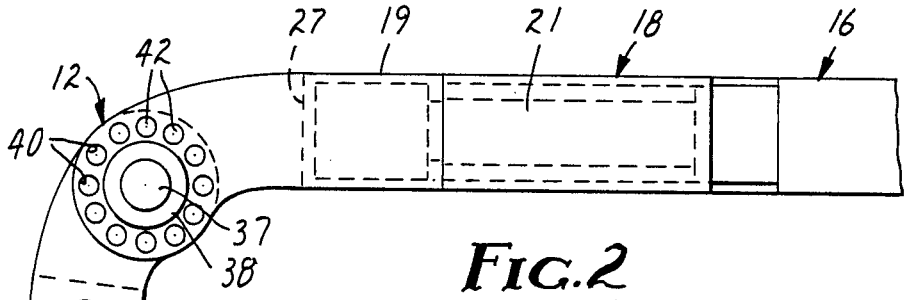
FIG. 2 is a top view of a hinge joining two adjacent panels and portions of the adjacent panels.
Figure 3:
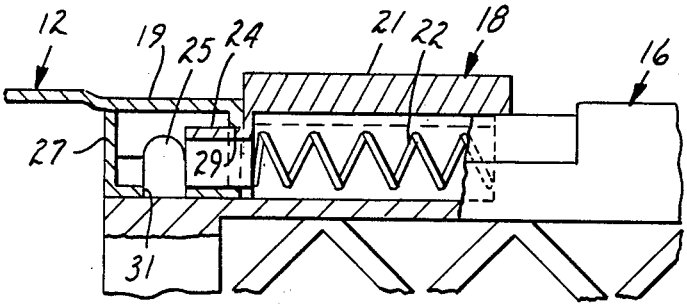
FIG. 3 is a side elevation view partially in section illustrating the retention mechanism at the top of one of the panels.
Figure 5:
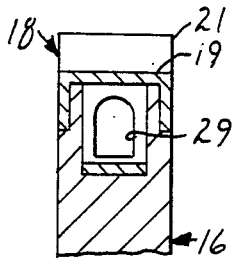
FIGS. 5 and 6 are cross-sectional views taken generally along line 5—5 of FIG. 4 with different parts removed for clarity.
Figure 6:
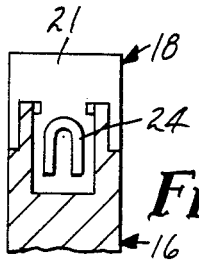
Figure 4:
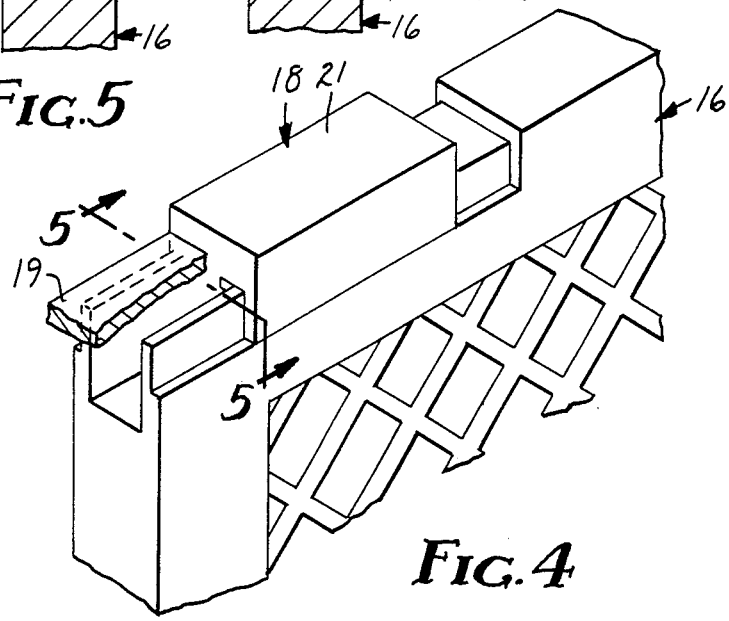
FIG. 4 is a perspective view showing the top one face and one edge of a panel with its slide mechanism and a partial sectional view of the hinge end from the adjacent panel.

The multiple panel play area unit of the present invention comprises a plurality of rectangular panels 10 connected by upper hinge structures 12 and lower hinge structures 14 permitting the panels to pivot with respect to each other at the hinges. Each panel has a rigid rectangular frame and in the illustrated embodiment there is also a rigid vertical center strut with the open areas of the frame filled with a mesh. In the preferred embodiment the entire panel is molded of plastic.

The top of a first panel 16 of two adjacent panels 16 and 17 is formed with a releasable retaining means for releasably retaining one end 19 of the hinge structure 12 connecting the tops of the two panels. The one end 19 of the hinge structure 12 is complementarily formed for being retained by the releasable retaining means 18. The opposite end of the upper hinge structure 12 is rigidly attached to the top of the panel 17 by a pair of screws 20.

The releasable retaining means 18 comprises a plastic slide 21 slidable along the top of the panel 16 adjacent one end thereof and urged by a compression spring 22 toward the end thereof. The leading end of the slide 21 is formed with a plunger 24 which is urged against a vertical pin 25 near the end of the panel, the pin 25 acting as a stop preventing the slide 21 from being expelled from the panel by the compression spring 22.

The hinge structures are preferably formed of zinc-plated sheet steel for weatherability. The mating end 19 of the upper hinge 12 is formed with a portion 27 that is U-shaped in side view. The U-shaped portion 27 has a plunger recess formed as an aperture 29 in its leading vertical wall for receiving the plunger 24 on the slide 21. It is also has a pin mating recess formed as an aperture 31 in the base of the U for mating with the pin 25 at the top of the panel 16. When the slide mechanism 21 is held in the open position illustrated in FIG. 7 against the force of the spring 22, the mating end 19 of the upper hinge 12 can be positioned over the pin 25 and moved downward to mate its aperture 31 with the pin 25 which defines the retention position for the hinge end 19. Release of the slide 21 then urges it forward causing the plunger 24 to move into the plunger aperture 29 in the end of the hinge and engage the pin 25 defining the retention position of the slide mechanism thereby locking the upper hinge 12 to the panel 16.

The lower hinge 14 is rigidly attached at one end to the bottom of the first panel 16 by a pair of screws 32. Its opposite end and the bottom of the second panel 17 are formed with a pin and a mating recess that are matable in a direction parallel to the hinge pivot axis. In the illustrated embodiment the bottom of the panel 17 is formed with a pin 33 and the end of the hinge 14 is formed with a corresponding aperture 35. And, in the illustrated embodiment the bottom of each panel and has a projection like pin which act as legs for the play area unit.

Each hinge pivot includes a pivot pin 37 and a pair of spring washers 38, one on each face of the hinge. In a circle around the pivot pin 37 one of the hinge halves is formed with equally spaced apertures 40 and the other hinge half is formed with corresponding protrusions 42. Thus, the spring washers 38 resiliently press the two portions of each hinge together so that each mating of a protrusion 42 with an aperture 40 defines a discrete position for the hinge and will hold the panels in a particular position to which they are pivoted.

In the preferred embodiment each pair of adjacent panels is formed to mate as described above for panels 16 and 17. Thus, one end of each panel is as described above for panel 16 and the opposite end of the panel is as described above for panel 17.

Figure 7:
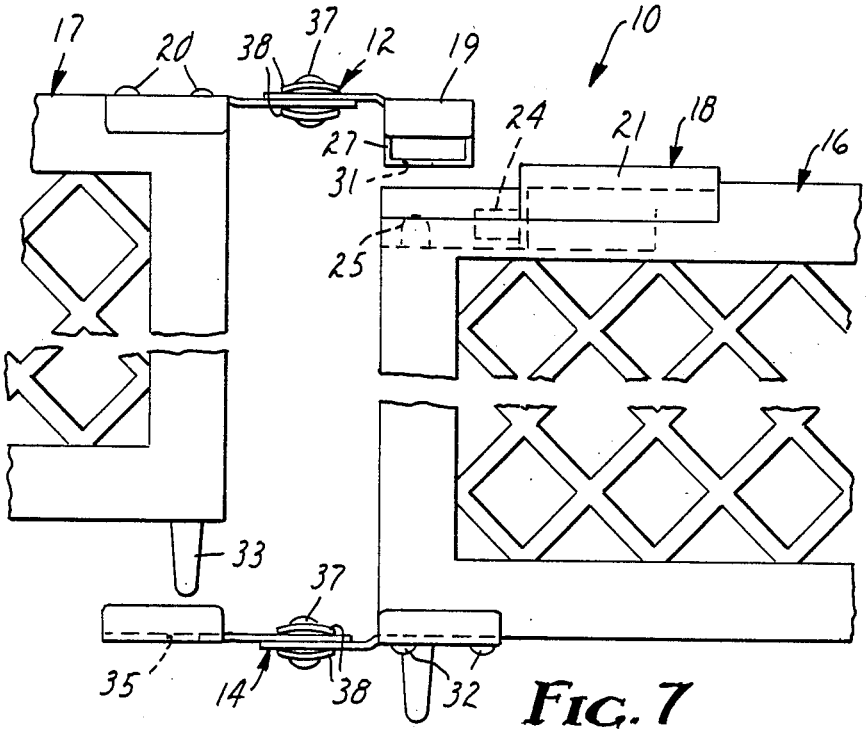
FIG. 7 is a side elevation view of a pair of adjacent panels with their hinge structures in position for mating.

In use, panel ends 16 and 17 may be assembled by positioning them as illustrated in FIG. 7 with the mating end 19 of the upper hinge 12 above the pin 25 on panel 16, the pin 33 on the bottom of panel 17 above the aperture 35 in the end of the lower hinge 14 and the slide 21 manually held in its open position against the force of the spring 22. The panel end 17 is then moved downward to mate aperture 31 in the upper hinge 12 with the pin 25 and pin 33 at the bottom of panel 17 with the aperture 35 at the end of hinge 14. The slide 21 is then released and spring 22 urges it forward to mate the plunger 24 with the aperture 29 in the end 19 of the upper hinge 12 to retain the panel ends 16 and 17 together.

I claim:

1. In a multiple panel unit for creating a play area for young children in which each panel has a rigid rectangular frame and is connected to an adjacent panel by a hinge structure at the top and bottom of the panels, permitting the panels to be pivoted with respect to each other at the hinge, the improvement comprising:

the top of a first of two adjacent panels having a releasable retaining means for releasably retaining one end of the hinge structure connecting said two panels and said one end of the hinge structure being complementarily formed for being retained by said releasable retaining means, said releasable retaining means including a spring loaded slide mechanism for retaining the hinge end when the slide mechanism is first held in an open position against the force of the spring and the hinge end is positioned in its retention position and the slide mechanism is then released and urged to its retention position by said spring, the bottom of the second of said two adjacent panels and the corresponding end of the bottom hinge structure being formed with a pin and a mating recess that are matable in a direction parallel to the hinge pivot axis.

2. The multiple panel unit of claim 1 wherein said releasable retaining means for releasably retaining one end of the hinge structure connecting said two adjacent panels includes the top of said first of said two adjacent panels and said one end of said hinge structure being formed with a pin and a mating recess that are matable in a direction parallel to said pin and mating recess at the bottom of said second of the two adjacent panels.

3. The multiple panel unit of claim 1 wherein said pin is on the top of said first of said two adjacent panels and said mating recess is formed adjacent said one end of said hinge structure.

4. The multiple panel unit of claim 3 wherein said releasable retaining means includes a plunger forming part of said slide mechanism matable with a recess in the end of the hinge structure when the slide mechanism is first held in said open position against the force of said spring, the hinge end is positioned in its said retention position with its recess mated with said pin on the top of said first of said two adjacent panels and said slide mechanism is then released and urged to its said retention position by said spring.

5. The multiple panel unit of claim 4 wherein when said end of said upper hinge structure is removed from said releasable retaining means and said slide mechanism is released said plunger engages against said pin on the top of said first of said two adjacent panels which pin then acts as a stop to prevent further movement of said slide mechanism by said spring.

6. The multiple panel unit of claim 1 wherein each pair of adjacent panels has one end of the hinge structure at the top of the panels releasably retained as recited in claim 1 and the bottom of the other panel mated with the end of the bottom hinge structure as recited in claim 1.

7. The multiple panel unit of claim 1 wherein the bottom of said second of said two adjacent panels is formed with a pin and, said corresponding end of the bottom hinge structure is formed with a mating recess.

* * * * *